US007531965B2

(12) United States Patent
Okamoto et al.

(10) Patent No.: US 7,531,965 B2
(45) Date of Patent: May 12, 2009

(54) DISCHARGE CENTERING LAMP LIGHTING DEVICE

(75) Inventors: Masashi Okamoto, Hyogo (JP); Izumi Takaya, Himeji (JP); Masaaki Uehara, Himeji (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 459 days.

(21) Appl. No.: 11/449,661

(22) Filed: Jun. 9, 2006

(65) Prior Publication Data

US 2007/0285030 A1 Dec. 13, 2007

(30) Foreign Application Priority Data

Jun. 9, 2005 (JP) ..... 2005-169163

(51) Int. Cl.
*H05B 37/02* (2006.01)

(52) U.S. Cl. ..... 315/209 R; 315/291; 315/225; 315/DIG. 7

(58) Field of Classification Search ..... 315/291, 315/209 R, 276, 278, 224, 225, 246, 307
See application file for complete search history.

(56) References Cited

U.S. PATENT DOCUMENTS 6,376,998 B1 4/2002 Okamoto et al.
6,552,502 B2 * 4/2003 Okamoto et al. ..... 315/336
6,661,184 B2 * 12/2003 Okamoto et al. ..... 315/291
6,734,643 B2 * 5/2004 Okamoto et al. ..... 315/336
6,756,744 B2 * 6/2004 Furukawa ..... 315/224
6,759,811 B2 * 7/2004 Okamoto et al. ..... 315/291
7,138,769 B2 * 11/2006 Suzuki et al. ..... 315/209 R
2006/0028151 A1 * 2/2006 Suzuki et al. ..... 315/291

FOREIGN PATENT DOCUMENTS

JP 05-234685 A 9/1993
JP 2001-006895 A 12/2001
JP 2002-117990 A 4/2002

* cited by examiner

*Primary Examiner*—Douglas W. Owens
*Assistant Examiner*—Ephrem Alemu
(74) *Attorney, Agent, or Firm*—Rader, Fishman & Grauer, PLLC

(57) ABSTRACT

A discharge lamp lighting device can reduce a variation in luminous flux at the time when the polarity of a voltage to be applied to the discharge lamp is inverted, prevent an excessively large amount of current from flowing through the discharge lamp at the time of starting, prevent the fade-out of discharge when the discharge mode returns from an arc discharge mode to a glow discharge mode, and reduce the ripple of a lamp current in a normal lighting mode. A coil is provided in an output current path of a power supply circuit comprising, for example, a step-down chopper, and a smoothing capacitor is provided in the next stage of the coil so that it selectively is turned on or off by a switching element. An inverter comprising, for example, a full bridge is provided in the next stage of the smoothing capacitor.

12 Claims, 6 Drawing Sheets

DISCHARGE CENTERING LAMP LIGHTING DEVICE

RELATED APPLICATION

The disclosure of Japanese Patent Application No. 2005-169163, filed Jun. 9, 2006, including the specification, claims and drawings, is incorporated herein by reference in its entirety.

FIELD

The present invention relates to a discharge lamp lighting device for lighting a discharge lamp, in particular, a high intensity discharge lamp, such as a high-pressure mercury lamp, a metal halide lamp, and a xenon lamp.

BACKGROUND

For example, a high intensity discharge lamp (an HID lamp) is used as a light source device of an image displaying optical apparatus, such as a liquid crystal projector or a DLP(™) projector.

In such a projector, light is divided into three primary colors R, G, and B by, for example, a dichroic prism, so that images are formed by spatial modulating elements corresponding to these three colors, and the R, G, and B image paths are re-synthesized by, for example, the dichroic prism, thereby displaying a color image.

According to another image forming method, light emitted from a light source passes through an R, G, B color filter which is rotated to sequentially generate R, G, and B light beams, and, in synchronization therewith, the spatial modulating elements are controlled to sequentially generate each of the three primary color images in a shifted time manner, thereby displaying a color image.

In order to turn on such a discharge lamp, while a voltage, called a no-load open circuit voltage, is applied to the discharge lamp, a high voltage is applied to the lamp to generate a breakdown in a discharge space of the lamp, so that a glow discharge and an arc discharge sequentially occur.

A high voltage can be applied to the lamp in either a method of applying a high voltage to main discharge electrodes of the lamp by using an igniter, that is, a serial trigger method, or a method of applying a high voltage to an auxiliary electrode provided so as not to come in contact with the discharge space in addition to the main discharge electrodes in the discharge space, that is, an external trigger method.

As compared with the serial trigger method, the external trigger method has an advantage in that, when a high-voltage generating unit including a high-voltage transformer is separated from a power supply circuit and is provided in the vicinity of a discharge lamp, it is possible to reduce the size, weight, noise, and manufacturing costs of a discharge lamp lighting device and to improve the stability of the discharge lamp lighting device.

On the other hand, discharge lamps in a normal lighting operation, are classified to two methods, a direct current driving method and an alternating current driving method.

In the direct current driving method, luminous flux from the lamp does not vary overtime as in a direct current. Therefore, the direct current driving method can be applied to either type of projectors.

In contrast, the alternating current driving method has an advantage in that it is possible to control the abrasion and growth of electrodes of a discharge lamp by using the degree of freedom, such as a polarity inverting frequency, that does not exist in the direct current driving method but it has problems which are attributed to polarity inversion.

In general, whenever the polarity inversion occurs performed in the alternating current driving method, for example, discontinuity of luminous flux from the lamp, an overshoot, and oscillation may occur. Therefore, in the projector driven by a time division system, asynchronism occurs between a timing when images are sequentially generated by time division and a polarity inversion timing when alternating current driving is performed on the lamp, that is, a displayed image is so excessively distorted at a peak frequency that it cannot be clearly recognized. Therefore, means for synchronizing the polarity inverting timing of the inverter with the rotation of color filters whose structure of the discharge lamp lighting device will be complicated, is needed.

Further, in the DLP-type projector, the brightness of the color of each pixel of a displayed image is controlled by an operational duty cycle ratio of the spatial modulating element in operation. In the alternating current driving method, even when the timing is synchronized, it is necessary to prevent light from being used or it is necessary to control the operation of each pixel of the spatial modulating element such that the variation in luminous flux is removed when a period in which a variation in luminous flux, such as an overshoot or oscillation, occurs at the time of polarity inversion, continues for a long time.

In the former case, the usage efficiency of light becomes low. In the latter case, it is difficult to control the spatial modulating elements of the projector.

In order to solve the above-mentioned problems of the method of driving the discharge lamp in the alternating current driving method, it is preferable to reduce the variation in luminous flux at the time of polarity inversion, but it is difficult to reduce the variation for the reasons set forth below.

That is, in the discharge lamp lighting device, it is necessary to reduce the variation in luminous flux when the polarity of a voltage applied to the lamp is inverted, to prevent an excessively large amount of current from flowing through the discharge lamp at the time of starting, to prevent the fade-out of discharge in the discharge lamp when a discharge mode is changed back from an arc discharge to a glow discharge, after changing to the glow discharge, and to reduce the ripple of a lamp current in a normal lighting mode.

When an excessively large amount of current flows through the lamp, the electrodes of the discharge lamp are damaged. When the fade-out of discharge occurs, the discharge lamp should be reignited. Thus, the life span of the lamp may be shortened. When a large ripple occurs in the lamp current in the normal lighting mode, the acoustic resonance of discharge occurs, thereby causing a flicker. For these reason, the above-mentioned requirements should be satisfied.

Japanese Unexamined Patent Application Publication No. 05-234685 discloses that, in order to improve the startability of a discharge lamp, a boost current flows through a discharge lamp, such as a metal halide lamp, at the time of starting by using a boost voltage circuit and charges stored in a boosting capacitor, while preventing an excessively large amount of peak current from flowing through it by, for example, a current restricting resistor, and after the start-up, the current restricting resistor is closed by a switch so that the boosting capacitor functions as a smoothing capacitor for reducing the ripple.

Japanese Unexamined Patent Application Publication No. 05-234685 also discloses that in order to an excessively large amount of peak current from flowing at the time of starting and to reduce the ripple of a lamp current in the normal lighting operation by the boost voltage circuit switch used as a switch for short-circuiting the current restricting resistor of the boosting capacitor.

However, at the time when the discharge lamp is driven by the alternating current driving method, the above art cannot be applied to reduce a variation in luminous flux when the polarity of a voltage applied to the lamp is inverted. In addition, when the discharge returns from the arc discharge to the glow discharge, the above-mentioned technology cannot effectively prevent the fade-out of discharge.

Further, a down-chopper circuit cannot respond to the high-speed change from a breakdown to an arc discharge since a smoothing capacitor should be charged, thereby causing the arc discharge to fail. In order to solve this problem, Japanese Unexamined Patent Application Publication No. 2000-123989 discloses that a switch is attached in a smoothing capacitor so as to decrease the capacitance of the smoothing capacitor when a breakdown by an igniter is transferred to an arc discharge from a glow discharge and then to increase the capacitance of the smoothing capacitor after or immediately after the discharge is transferred to the arc discharge, thereby reducing the ripple of a lamp current.

However, at the time when the discharge lamp is driven by the alternating current driving method, the art cannot reduce a variation in luminous flux when the polarity of a voltage applied to the lamp is inverted. In addition, when the discharge mode returns from the arc discharge to the glow discharge, the above-mentioned art cannot effectively prevent the fade-out of discharge.

Japanese Unexamined Patent Application Publication No. 2001-006895 discloses the capacitance of a smoothing capacitor of an output variable direct current source is increased when a discharge mode is transferred to an arc discharge after a glow discharge is completed, in order to prevent the fade-out of discharge when a high-pressure mercury lamp returns from the arc discharge to the glow discharge, to prevent an excessively large amount of current from flowing at the time of starting, and to reduce the ripple of a lamp current in a normal lighting mode.

However, at the time when the discharge lamp is driven by the alternating current driving method, this art cannot reduce a variation in luminous flux when the polarity of a voltage applied to the lamp is inverted.

Further, Japanese Unexamined Patent Application Publication No. 2002-117990 discloses the capacitance of a smoothing capacitor immediately is decreased after the lighting of a discharge lamp is transferred from a glow discharge mode to an arc discharge, and the capacitance of the smoothing capacitor is increased when the arc discharge is stably maintained, in order to prevent the fade-out of discharge when the discharge lamp returns from the arc discharge mode to the glow discharge mode and to reduce the ripple of a lamp current in a normal lighting mode.

However, at the time when the discharge lamp is started by the alternating current driving method, this art cannot reduce a variation in luminous flux when the polarity of a voltage applied to the lamp is inverted. In addition, the above-mentioned art cannot effectively prevent an excessively large amount of current from flowing through the discharge lamp at the time of starting.

SUMMARY

Accordingly, an object of the invention is to provide a discharge lamp lighting device capable of, when a discharge lamp is turned on by an alternating current driving method, reducing a variation in luminous flux at the time when the polarity of a voltage to be applied to the discharge lamp is inverted, of preventing an excessively large amount of current from flowing through the discharge lamp at the time of starting, of preventing the fade-out of discharge when the discharge mode returns from an arc discharge mode to a glow discharge mode, and of reducing the ripple of a lamp current in a normal lighting mode.

The present discharge lamp lighting device which turns on a discharge lamp by an arc discharge, comprises a power supply circuit which supplies power to the discharge lamp, an inverter which is provided in a downstream side of the power supply circuit and inverts polarity of a voltage to be applied to the discharge lamp, a coil which is provided between the power supply circuit and the inverter, and a series connection circuit of a capacitor and a switching element which is connected in parallel to power input side nodes of the inverter, wherein the switching element is controlled to be turned on after discharge state of the discharge lamp is changed to an arc discharge, and when the inverter performs polarity inversion, a dead time period is controlled so as to be 2 μs or shorter at least in a normal lighting operation of the discharge lamp.

In the discharge lamp lighting device, the power supply circuit may include an output current detecting unit which detects an output current of the power supply circuit and generates an output current detecting signal, an output current error calculating circuit which calculates an error between the output current detecting signal and an output current target signal indicating a control target value with respect to the output current detecting signal, and a power supply driving circuit which defines a capability of the power supply circuit based on the output of the output current error calculating circuit, and at least in the normal lighting operation of the discharge lamp, at least one of an output signal of the output current error calculating circuit and the output current detecting signal is held for a predetermined period including the dead time period ($\tau d$) of the inverter.

The discharge lamp lighting device may further comprise a booster which includes a primary coil and a secondary coil and temporarily raises a no-load open circuit voltage to be applied to the discharge lamp at time of starting, and a trigger unit which is provided to apply a voltage to the primary coil so that a predetermined boosting voltage is generated in the secondary coil, wherein the secondary coil is provided between an output node of the inverter and the discharge lamp (Ld), and the inductance of the secondary coil is set to be 60 μH or smaller.

The discharge lamp lighting device may further may comprise a booster which includes a primary coil and a secondary coil and temporarily raises a no-load open circuit voltage to be applied to the discharge lamp at time of starting, and a trigger unit that is provided to apply a voltage to the primary coil so that a predetermined boosting voltage is generated in the secondary coil, wherein the secondary coil is provided between an output node of the inverter and the discharge lamp, and the primary coil is shorted at least in the normal lighting operation of the discharge lamp.

In the discharge lamp lighting device, an overshoot of an absolute value of a current flowing through the discharge lamp may be 15% or lower when the inverter performs the polarity inversion.

As described above, in the present discharge lamp lighting device, it is possible to reduce, when a discharge lamp is turned on by an alternating current driving method, a variation in luminous flux at the time when the polarity of a voltage to be applied to the discharge lamp is inverted, to prevent an excessively large amount of current from flowing through the discharge lamp at the time of starting, to prevent the fade-out of discharge when the discharge mode returns from an arc discharge mode to a glow discharge mode, and to reduce the ripple of a lamp current in a normal lighting mode.

BRIEF DESCRIPTION OF THE DRAWINGS

Other features and advantages of the present discharge lamp lighting device will be apparent from the ensuing description, taken in conjunction with the accompanying drawings, in which.

DETAILED DESCRIPTION OF THE INVENTION

While the claims are not limited to the illustrated embodiments, an appreciation of various aspects of the present discharge lamp lighting device is best gained through a discussion of various examples thereof.

Figure 1:
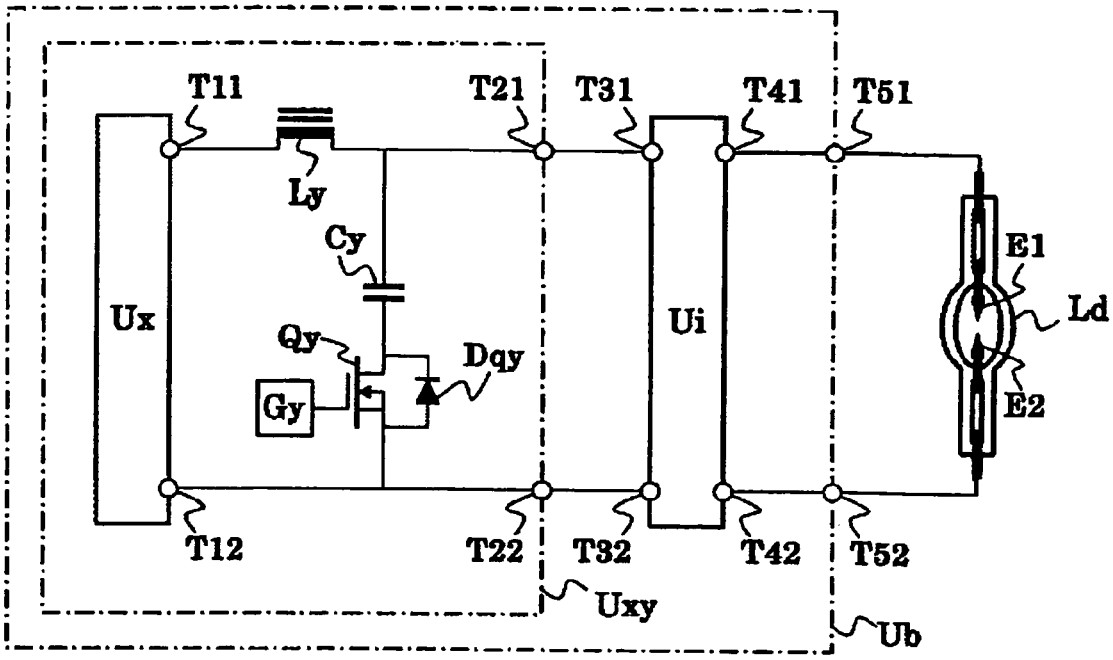
FIG. 1 is a block diagram schematically illustrating a discharge lamp lighting device according to an embodiment.

FIG. 1 is a block diagram schematically illustrating an embodiment of a discharge lamp lighting. An embodiment of the invention will be described with reference to FIG. 1.

A power supply circuit (Ux) comprising a down-chopper-type or up-chopper-type switching circuit outputs a suitable voltage and current according to the state or lighting sequence of a discharge lamp (Ld).

In inverter (Ui) comprising, for example, a full-bridge circuit converts the voltage outputted from the power supply circuit (Ux) into an alternating voltage whose polarity is periodically inverted, and applies the alternating voltage to a pair of main discharge electrodes (E1 and E2) of the discharge lamp (Ld).

In general, a no-load open circuit voltage applied to the discharge lamp (Ld) at the time of start is about 300 V. A lamp voltage at the time of glow discharge is in the range of about 100 to 200 V. The lamp voltage is about 10 V immediately after discharge changes to an arc discharge. The power supply circuit (Ux) controls a current during the glow discharge and the arc discharge so as not to exceed a predetermined limit current value.

A coil (Ly) is provided in a path between output nodes (T11 and T12) of the power supply circuit (Ux) and input nodes (T31 and T32) of the inverter (Ui), and a series circuit of a capacitor (Cy) and a switching element (Qy) composed of, for example, an FET is connected in parallel to the input nodes (T31 and T32) of the inverter (Ui).

An off state of the switching element (Qy) is kept when the discharge lamp is turned off, and when a no-load open circuit voltage is applied at the time of starting, or before the discharge changes to an arc discharge even after starting, that is, during the glow discharge or during a period where the discharge may return to the glow discharge.

The off state of the switching element (Qy) means a state in which at least no current is charged to the capacitor (Cy), no current is discharged from the capacitor (Cy), or no current is charged/discharged to/from the capacitor (Cy).

On the other hand, while in the on state of the switching element (Qy), the charge and discharge of the capacitor (Cy) should not be prevented.

When the switching element (Qy) is composed of, for example, a MOSFET, even in the off state of the switching element (Qy), current from the capacitor (Cy) is not prevented from discharging since a forward parasitic diode between a source and a drain is provided therein.

In order to clearly explain it, a parasitic diode (Dqy) is shown in FIG. 1.

When a semiconductor element that does not allow a bi-directional current flow is used as the switching element (Qy), it is necessary to mount a diode corresponding to the parasitic diode (Dqy) in parallel to the semiconductor element.

Further, an element having a mechanical contact, such as a relay, can be used as the switching element (Qy). In this case, since a bi-directional current can flow, it is not necessary to mount the diode in parallel to the element having the mechanical contact.

Accordingly, no current flows through the capacitor (Cy) due to the voltage outputted from the power supply circuit (Ux). Therefore, a discharge current depending on a difference between a glow discharge voltage and a no-load open circuit voltage applied to the discharge lamp (Ld) before starting does not flow from the capacitor (Cy) to the discharge lamp (Ld) when the discharge lamp (Ld) is in a glow discharge mode, or a discharge current depending on a difference between an arc discharge voltage and a no-load open circuit voltage or a glow discharge voltage does not flow from the capacitor (Cy) to the discharge lamp (Ld) when the discharge lamp is in an arc discharge.

Further, in general, a smoothing capacitor is provided in parallel to the output nodes (T11 and T12) of the power supply circuit (Ux). Since the coil (Ly) is provided, the amount of current outputted from the smoothing capacitor is reduced.

As described above, in the arc discharge, the discharge lamp (Ld) may return to the glow discharge mode.

This phenomenon may occur in a high-pressure mercury lamp. For example, when liquid mercury adheres to a cathode of the high-pressure mercury lamp, an arc discharge, which is a kind of field emission, selectively occurs in a portion of the cathode where the liquid mercury adheres even when the cathode is not heated at a sufficient temperature for thermionic emission. Since the liquid mercury is evaporated during the progression of discharge, when the liquid mercury is exhausted, the field emission does not occur, so that the arc discharge instantly stops.

This phenomenon similarly occurs in a discharge lamp having a material which is not evaporated at low temperate.

In this case, in the arc discharge period during which a lamp voltage is low, since a predetermined limit current flowing through the coil (Ly) is instantly stopped, the coil (Ly) works so as to rapidly raise the voltage to be applied to the discharge lamp (Ld) by its induction operation.

When a capacitor having a large capacitance is connected to the rear end of the coil (Ly), energy generated by the induction operation of the coil (Ly) is used to charge the capacitor. Therefore, it is difficult to rapidly raise the lamp voltage to a glow discharge voltage by the power supply operation of power supply circuit (Ux), the discharge of the discharge lamp (Ld) cannot be transferred to the glow discharge, resulting in the fade-out of discharge.

In the discharge lamp lighting device according to this embodiment, as described above, the off state of the switching element (Qy) is kept off before the discharge of the lamp is completely transferred to the arc discharge, that is, in the glow discharge period or in a period where the discharge lamp may be transferred to the glow discharge mode. Therefore, when the arc discharge of the discharge lamp (Ld) stops, as described above, energy generated by the induction operation of the coil (Ly) is not used to charge the capacitor (Cy), so that it possible for the discharge of the lamp (Ld) to be directly transferred to the glow discharge.

In a period where the discharge lamp (Ld) is completely transferred to the arc discharge mode, that is, in a period where the discharge lamp (Ld) may not return to the glow discharge mode, a gate driving circuit (Gy) controls the switching element (Qy) to be turned on. In this case, the coil (Ly) can prevent a high-frequency current, and the capacitor (Cy) can perform a smoothing operation, so that it is possible to effectively remove ripples caused by the switching operation of the power supply circuit (Ux).

Meanwhile, in a normal lighting state of the discharge lamp (Ld), when a lamp current varies over time, the brightness waveform of light emitted from the discharge lamp approximately corresponds to that of the absolute value of the lamp current. However, since the discharge lamp has thermal capacity, a slight time delay occurs between a variation in lamp current and a variation in brightness.

This means that, even when the flow of the lamp current stops instantly, the brightness of the lamp is not directly changed to zero, and when the length of a period where no current flows is short in view of measuring the time delay on a scale, there is no problem from the practical point of view.

The inverter (Ui) is controlled such that a dead time period ($\tau d$) at the time of polarity inversion does not exceed 2 μs, which is a time scale close to the time delay. Therefore, it is possible to reduce the influence to a variation in luminous flux due to the stop of the lamp current caused by the dead time period of the inverter (Ui), to the extent that problems do not arise from a practical point of view.

The instant stop of the lamp current due to the dead time period affects the coil (Ly) provided in the upstream of the inverter (Ui), and thus a spike or oscillation may be mixed with the lamp current due to the induction operation of the coil. However, after the discharge of the lamp (Ld) is completely transferred to the arc discharge, the switching element (Qy) is controlled to be turned on, so that the capacitor (Cy) is connected to a circuit. Therefore, it is possible to reduce an undesirable phenomenon caused by the induction operation of the coil (Ly) to the extent that problems do not arise from the practical point of view by appropriately setting the capacitance of the capacitor (Cy).

As described above, according to the structure of this embodiment shown in FIG. 1, it is possible to reduce a variation in luminous flux when the polarity of a voltage applied to the lamp varies, to prevent an excessively large amount of current from flowing through the discharge lamp when the discharge lamp starts, to prevent the fade-out of discharge when the discharge mode of the discharge lamp returns from the arc discharge mode to the glow discharge mode, and to reduce the ripple of the lamp current when the discharge lamp is normally turned on.

A supplementary description will be given below as to a method of detecting that the discharge of the lamp (Ld) is completely transferred to the arc discharge, at which the switching element (Qy) is made to be in an on state.

As described above, the return of the discharge to the glow discharge occurs due to material enclosed in the lamp and adheres to the electrodes, such as liquid mercury. Therefore, assuming the worst case, all the enclosed material adheres to both electrodes, it is possible to estimate the maximum time necessary to evaporate all the enclosed material by the arc discharge based on the field emission by using the limit value (for example, an allowable limit value (ILIM) of the lamp current, which will be described later) of the lamp current determined by the power supply circuit (Ux) during the arc discharge immediately after the discharge lamp starts.

Therefore, in an initial sequence of the discharge lamp, it is possible to detect that the discharge lamp is completely transferred to the arc discharge mode, that is, that a period where the discharge lamp may return to the glow discharge lamp has elapsed, by detecting at least the passage of the maximum time by using a timer unit that starts at time when the discharge of the lamp is transferred to the arc discharge.

Figure 2:
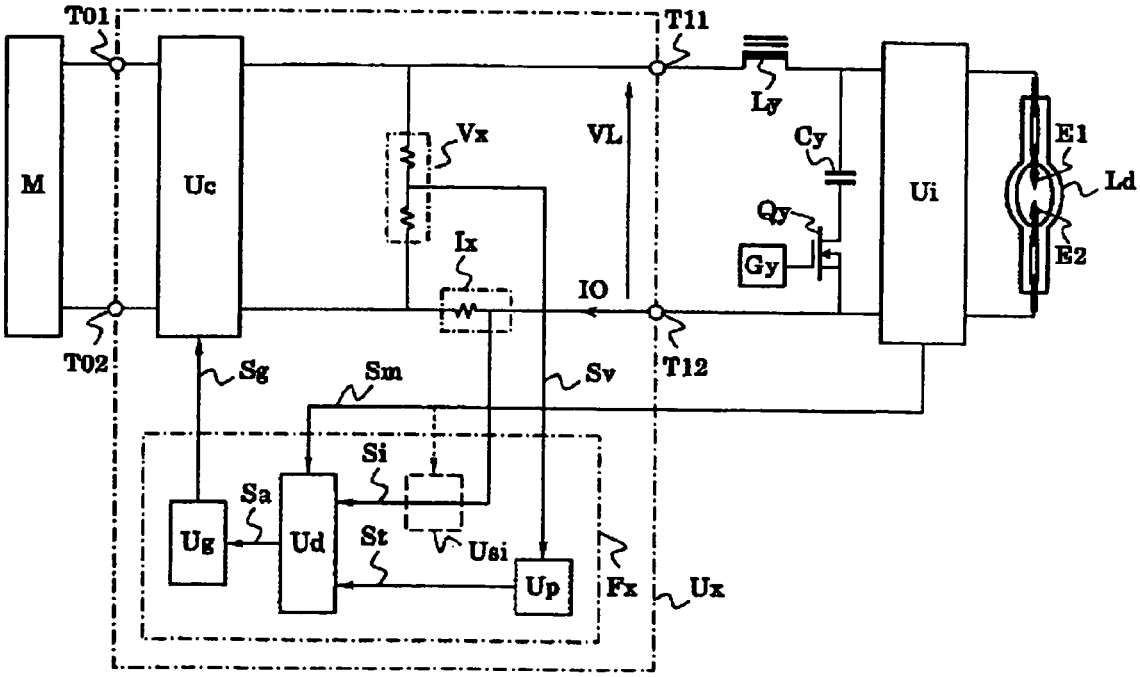
FIG. 2 is a block diagram schematically illustrating a discharge lamp lighting device according to another embodiment.

Next, another embodiment of the discharge lamp lighting device will be described below with reference to FIG. 2. FIG. 2 is a block diagram schematically illustrating another embodiment of the discharge lamp lighting device.

In the above-mentioned embodiment, it is discussed about the possibility of the instant stop of the lamp current due to the dead time period of the inverter (Ui) that affects the coil (Ly) provided in the upstream of the inverter (Ui). However, the structure shown in FIG. 2 positively prevents the instant stop of the lamp current due to the dead time period of the inverter (Ui) from affecting the power supply circuit (Ux) provided in the upstream of the coil (Ly) so as to reduce a variation in luminous flux when the polarity of a voltage applied to the lamp is inverted.

The power supply circuit (Ux) converts power supplied from a DC power supply (M) into power suitable for the discharge lamp (Ld) by using a converter (Uc) composed of a step-down chopper type or step-up chopper type switching circuit, as described above.

An output current detecting unit (Ix) detects an output current (IO) of the power supply circuit (Ux), that is, a lamp current, generates an output current detecting signal (Si), and outputs the generated signal to an output current error calculating circuit (Ud).

Further, when the output current detecting signal (Si) is a weak signal, for example, an amplifier may be provided, if necessary. However, in this embodiment, the amplifier is not provided A lamp voltage detecting unit (Vx) for generating a lamp voltage detecting signal (Sv) detects an output voltage (VL) of the power supply circuit (Ux), that is, a lamp voltage. A power control circuit (Up) determines a lamp current value for obtaining target power according to the lamp voltage, and outputs the determined value as an analog signal. For example, an output current target signal (St) is generated by the power control circuit (Up) including a microprocessor, and is then inputted to the output current error calculating circuit (Ud).

The output current error calculating circuit (Ud) calculates an error of the output current detecting signal (Si) with respect to the output current target signal (St), and controls a capability signal (Sa) for raising or lowering the capability of the converter (Uc) so as to reduce the error. Then, the output current error calculating circuit (Ud) outputs the capability signal (Sa).

A power supply driving circuit (Ug) receives the capability signal (Sa) and generates a gate driving signal (Sg) whose duty cycle is modulated in order to control switching elements of the converter (Uc).

Meanwhile, the inverter (Ui) sets a predetermined period including the dead time period (τd) at the time of polarity inversion, generates a polarity inversion period signal (Sm) in the predetermined period where an output current is not properly controlled due to polarity inversion, so as to input the generated signal to the output current error calculating circuit (Ud).

When the polarity inversion period signal (Sm) is activated, the output current error calculating circuit (Ud) holds the capability signal (Sa).

In such a structure, when the polarity inversion period signal (Sm) is in an inactive state, a current flowing through the discharge lamp (Ld) is controlled in a feedback manner such that power consumed in the discharge lamp (Ld) is held in a target power value.

When the polarity inversion period signal (Sm) is activated, the feedback control is stopped.

When the polarity inversion period signal (Sm) returns to the inactive state, the current flowing through the discharge lamp (Ld) is controlled in the feedback manner again such that the power consumed in the discharge lamp (Ld) is held in the target power value.

Further, when the polarity inversion period signal (Sm) is in the inactive state, the output current error calculating circuit (Ud) calculates an error of the output current detecting signal (Si) with respect to the output current target signal (St) and outputs the capability signal (Sa) (hold release state). However, when the polarity inversion period signal (Sm) is in an active state, the output current error calculating circuit (Ud) holds the output state of the capability signal (Sa) at time when the polarity inversion period signal (Sm) is activated, regardless of the state of-the output current detecting signal (Si) or the output current target signal (St), which is an input signal. That is, the output current error calculating circuit (Ud) has a hold function.

Next, the reason why the capability signal (Sa) is held at time when the polarity inversion period signal (Sm) is in an active state will be described below.

In the dead time period at the time of the polarity inversion of the inverter (Ui) which is included in the polarity inversion period signal (Sm), only a transient current, not a normal current, flows through the lamp. Therefore, the output current detecting signal (Si) detected and generated by the output current detecting unit (Ix) changes to a signal including a period where the level thereof is zero.

Therefore, if the capability signal (Sa) is not held, the output current error calculating circuit (Ud) detects a large error, so that the state of the capability signal (Sa) is rapidly changed to a state where the large capability of the converter (Uc) is needed. Therefore, when the directional change of the lamp current at the time of the next polarity inversion is completed, the output current error calculating circuit (Ud) is operated according to the state of the capability signal (Sa) where excessively high capability of the converter (Uc) is needed. Therefore, an excessively large amount of current flows through the discharge lamp (Ld), and oscillation occurs in the lamp current due to the feedback control function for restoring the large current value to a normal current value.

In order to prevent such a phenomenon, the capability signal (Sa) is held.

As represented by broken lines in FIG. 2, a lamp current detecting signal holding circuit (Usi) is provided to hold the signal detected by the output current detecting unit (Ix). In this structure, when the polarity inversion period signal (Sm) is in an active state, the lamp current detecting signal holding circuit (Usi) holds the output current detecting signal (Si). In this case, even when only a transient current, not a normal current, flows through the lamp, the output current detecting signal (Si) holds the state when the polarity inversion period signal (Sm) is activated, so that the output current error calculating circuit (Ud) does not detect a large error, which makes it possible to make the structure in which the capability signal (Sa) is not held.

In addition, it is preferable to hold both the output current detecting signal (Si) and the capability signal (Sa).

As described above, in the discharge lamp lighting device shown in FIG. 2, it is possible to prevent the instant stop of a lamp current due to the dead time period of the inverter (Ui) from affecting the power supply circuit (Ux) so as to reduce a variation in luminous flux when the polarity of a voltage applied to a lamp is inverted.

More specifically, preferably, when the polarity inversion period signal (Sm) is in an inactive state, a power control circuit (Up) outputs the output current target signal (St) on the basis of the lamp voltage detecting signal (Sv) (hold release state). On the other hand, preferably, when the polarity inversion period signal (Sm) is in an active state, the power control circuit (Up) holds the output state of the output current target signal (St) at time when the polarity inversion period signal (Sm) is activated, regardless of the state of the lamp voltage detecting signal (Sv), which is an input signal. That is, the output current error calculating circuit (Ud) has a hold function.

Since fluctuation exists in the output current detecting signal (Si) or the lamp voltage detecting signal (Sv), it is not certain that the polarity inversion period signal (Sm) will be activated when an error of the output current detecting signal (Si) with respect to the output current target signal (St) is zero. When the error exists in the period where the polarity inversion period signal (Sm) is in an active state, particularly when the output current error calculating circuit (Ud) is operated as an integrating circuit, the error is time-integrated. Therefore, when the polarity inversion period signal (Sm) returns to the inactive state, it requires a lot of time to return to the original state.

However, since the period where the polarity inversion period signal (Sm) is in the active state is very short, generally, there is no problem.

Similarly, when the polarity inversion period signal (Sm) is in an active state, preferably, the converter (Uc) stops its operation.

If the operation of the converter (Uc) does not stop, the smoothing capacitor (Cx) or the capacitor (Cy) is charged to cause the output voltage of the power supply circuit (Ux) to rise. Therefore, when the polarity inversion period signal (Sm) returns to the inactive state, there is a possibility that a current slightly larger than the current immediately before polarity inversion is performed will flow through the discharge lamp (Ld).

Figure 3:
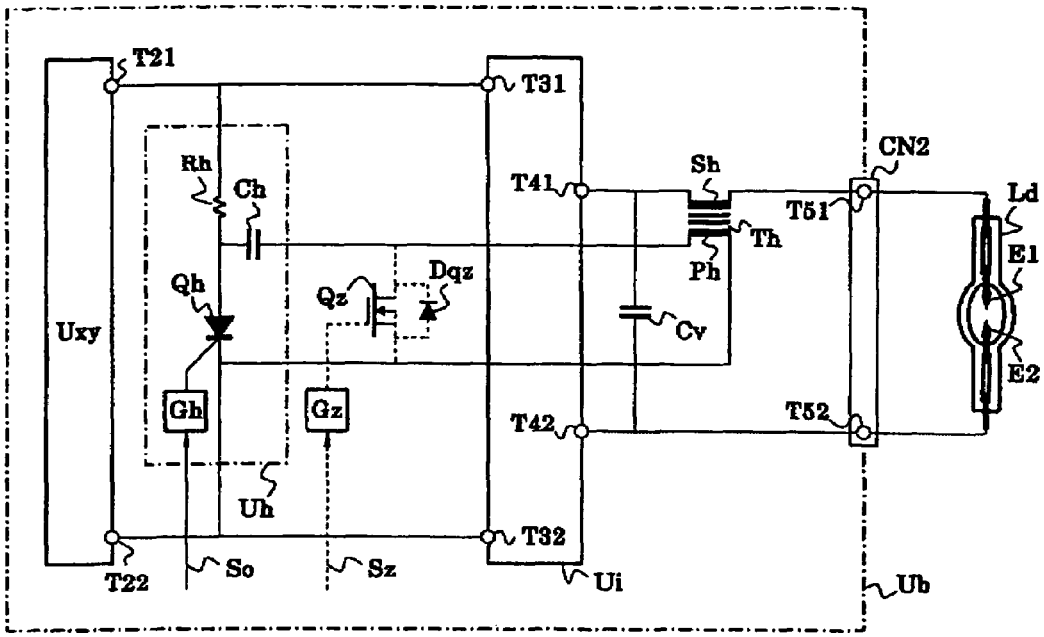
FIG. 3 is a diagram schematically illustrating a serial trigger type discharge lamp lighting device according to an embodiment.

Next, still another embodiment of a discharge lamp lighting device will be described below with reference to FIG. 3. FIG. 3 is a diagram of the discharge lamp lighting device including a booster (Th) for temporarily raising a no-load open circuit voltage to be applied to the discharge lamp (Ld).

For the purpose of simplicity of the illustration, a section composed of the power supply circuit (Ux), the coil (Ly) provided in the next stage of the power supply circuit (Ux), the capacitor (Cy), the switching element (Qy), and the gate driving circuit (Gy) is represented by a power supply circuit block (Uxy).

The booster (Th), serving as a serial trigger type igniter, includes a primary coil (Ph) and a secondary coil (Sh) for generating a high starting voltage. The secondary coil (Sh) is provided adjacent to one (the electrode (E1) in FIG. 3) of the main discharge electrodes (E1 and E2) of the discharge lamp (Ld) so as to be connected in series to the electrode.

At the time of starting the lamp, when a no-load open circuit voltage is supplied from the power supply circuit block (Uxy), a current is slowly charged into a capacitor (Ch) through the primary coil (Ph) and a resistor (Rh) of a trigger circuit (Uh).

When a gate driving circuit (Gh) is operated by a trigger signal (So) outputted from a microprocessor unit (Mpu) of a power supply control circuit (Fx), which will be described later, to cause a switching element (Qh) composed of, for example, an SCR to be rapidly turned on, the capacitor (Ch) is rapidly discharged through the switching element (Qh) and the primary coil (Ph), and thus a pulse signal flows through the primary coil (Ph).

This operation causes a high starting voltage to be generated to the secondary coil (Sh) and to overlap the no-load open circuit voltage. Then, a high voltage is applied to the discharge lamp (Ld) to raise the no-load open circuit voltage, and a breakdown occurs in the electrodes (E1 and E2), thereby turning on the discharge lamp (Ld).

A capacitor (Cv) electrically connects output nodes (T41 and T42) of the inverter (Ui) in a frequency manner to protect the inverter (Ui) from the high voltage of the secondary coil (Sh). Preferably, the capacitor (Cv) has a small capacitance of about 100 pF.

The secondary coil (Sh) should be provided in the latter stage of the inverter (Ui) in view of the positional relationship between the discharge lamp (Ld) and the secondary coil (Sh). In this case, when the inverter (Ui) performs polarity inversion, the response of the lamp current may be delayed or the lamp current may be oscillated, which may cause a problem from a practical point of view.

Since the larger the inductance of the secondary coil (Sh) becomes, the larger the degree of adverse effects are caused, it is necessary to set the impedance of the secondary coil to a small value.

Experiments were performed to test and evaluate the display quality under the operational conditions in order to look for the upper limit of the inductance of the secondary coil (Sh) without any problem in practical use, that is a DLP-type projector, including a discharge lamp (Ld) having a power of 135 W and a discharge lamp lighting device (a light source of the projectors) in which coils having various inductance values are provided in the latter stage of an inverter are provided in the projector, and the polarity inverting timing of the inverter is not synchronized with the rotation of each filter. The experiments show that, when a front projection type DLP projector for presentation has an insertion inductance smaller than 60 μH, practical problems do not arise.

In this case, the overshoot of the absolute value of a lamp current when the inverter performs polarity inversion is about 15%.

However, in a rear projection type DLP projector, since a half-tone image is strictly needed, it is preferable that the polarity inverting timing of the inverter be synchronized with the rotation of each filter or the insertion inductance be smaller than 40 μH.

In the discharge lamp lighting device shown in FIG. 3, a high voltage is applied to one of the electrodes (E1 and E2) of the discharge lamp (Ld). However, FIG. 4 shows the structure of a discharge lamp lighting device in which high voltages having different polarities are applied to both the electrodes (E1 and E2) of the discharge lamp (Ld).

Figure 4:
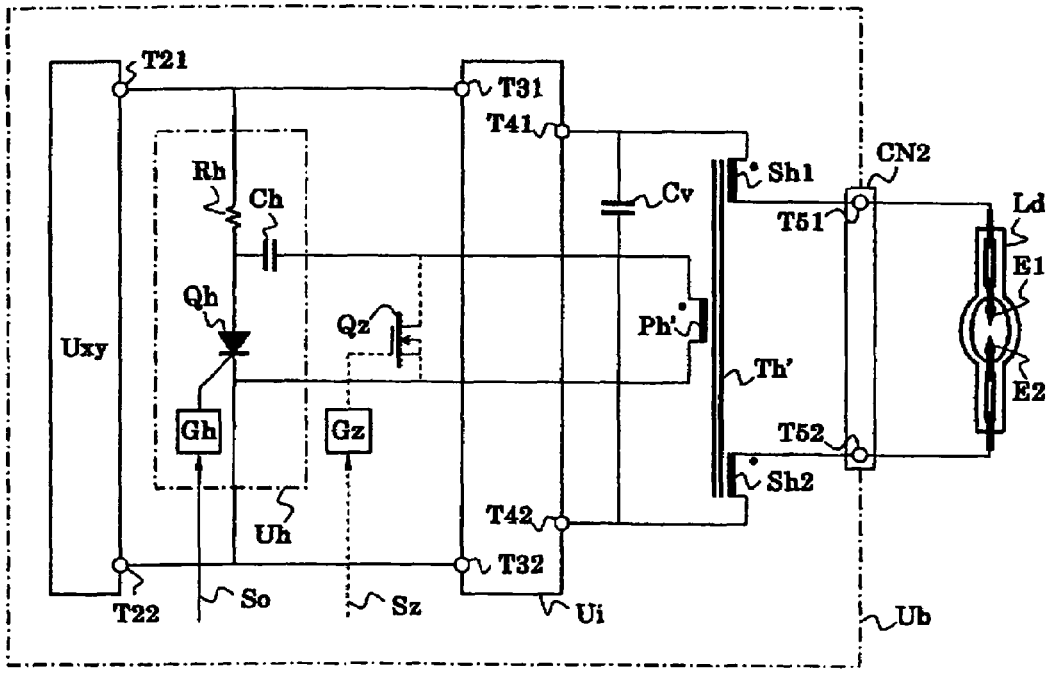
FIG. 4 is a diagram schematically illustrating a serial trigger type discharge lamp lighting device according to another embodiment.

In FIG. 4, a booster (Th') includes two secondary coils (Sh1 and Sh2), a primary coil (Ph'), and a trigger circuit (Uh). The structures of the primary coil (Ph') and the trigger circuit (Uh) are the same as those in FIG. 3.

In the booster (Th') having the above-mentioned structure, terminals of the secondary coils (Sh1 and Sh2) connected to the discharge lamp (Ld) are electrically connected to each other, and they are considered as one secondary coil. In this case, it is preferable that the inductance value of the one secondary coil do not exceed the upper limit value of inductance without practical problem.

Figure 5:
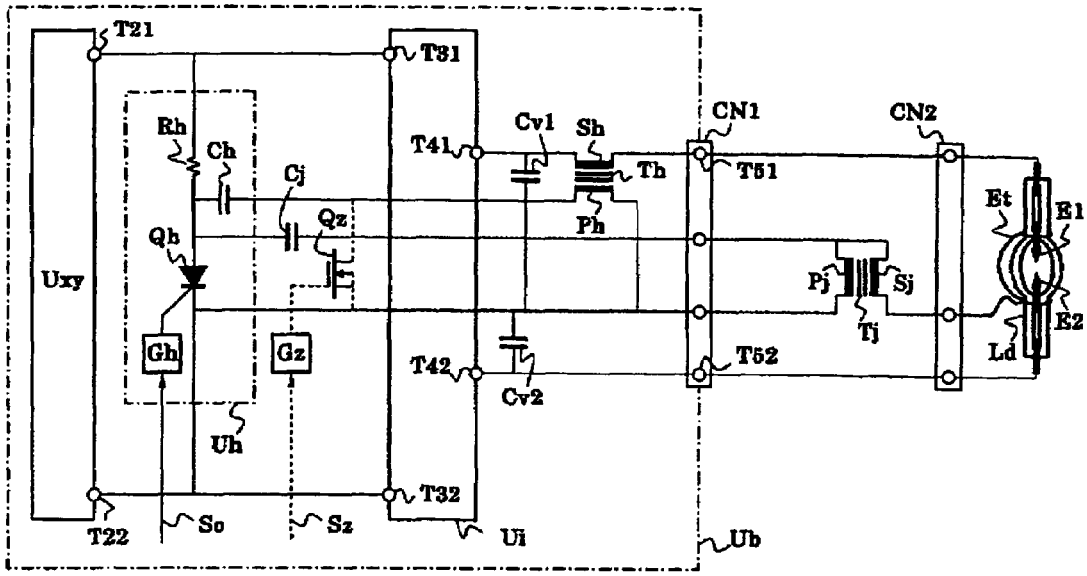
FIG. 5 is a diagram schematically illustrating an external trigger type discharge lamp lighting device according to an embodiment.

The discharge lamp lighting devices shown in FIGS. 3 and 4 are a serial trigger type where a high voltage is applied to one of or both the main discharge electrodes of the discharge lamp. However, FIG. 5 shows a discharge lamp lighting device of an external trigger type in which, in addition to the main discharge electrodes (E1 and E2), an auxiliary electrode (Et) is provided on the discharge lamp (Ld) so as not to contact a discharge space and a high voltage is applied to the auxiliary electrode (Et). The discharge lamp lighting device shown in FIG. 5 includes the booster (Th), similar to the structure shown in FIG. 3.

In the basic external trigger type, the booster (Th) is not needed.

However, when a lighting property needs to be improved under a hot restart condition where a lamp is turned off and is then turned on without a sufficient cooling period, it is effective to provide the booster (Th) to raise a no-load open circuit voltage.

However, when the booster (Th) is used as the serial trigger type igniter as shown in FIG. 3, an output voltage of several kilovolts to dozens of kilovolts is needed. In contrast, in the external trigger type booster (Th) for raising the no-load open circuit voltage, it is effective that an output voltage is about one kilovolt.

In FIG. 5, the structure of the trigger circuit (Uh) is the same as that shown in FIG. 3. However, a capacitor (Cj) is additionally provided such that, when a pulse current flows through the primary coil (Ph) of the booster (Th), the pulse current can also flow through a primary coil (Pj) of a high-voltage transformer (Tj) for applying a high voltage to the auxiliary electrode (Et).

In this way, a high voltage is generated from a secondary coil (Sj) of the high-voltage transformer (Tj) at a timing when a voltage for raising the no-load open circuit voltage is generated from the secondary coil (Sh) of the booster (Th), allowing the discharge lamp to effectively start.

Further, capacitors (Cv1 and Cv2) are used to protect the inverter (Ui), similar to the capacitor (Cv).

In the discharge lamp lighting device having the above-mentioned structure, it is preferable that the inductance of the second coil (Sh) of the booster (Th) do not exceed the limit value of inductance where no problem arises from a practical point of view.

In the discharge lamp lighting device including the booster for temporarily raising the no-load open circuit voltage applied to the discharge lamp (Ld), when it is difficult to adjust the inductance of the secondary coil of the booster so as not to exceed the limit value of inductance which causes no problem from a practical point of view or when the inductance of the secondary coil of the booster needs to be reduced, as represented by dot-dashed lines in FIGS. 3, 4, and 5, the structure set forth below can be used. A switching element (Qz) composed of, for example, an FET is provided in parallel to the primary coil (Ph or Ph') of the booster (Th or Th') and the gate driving circuit (Gz) turns on the switching element (Qz) to electrically connect the primary coil (Ph or Ph').

However, the switching element (Qz) is turned on after the discharge lamp is started.

In the on state of the switching element (Qz), it is necessary to break a current flowing through the primary coil (Ph or Ph') in any direction by reverse induction of the secondary coil (Sh, Sh1, or Sh2), similar to the on state of the switching element (Qy).

On the other hand, in the off state of the switching element (Qz), it is preferable to block a current flowing in a direction in which the operation of the trigger circuit (Uh) making a pulse current flow through the primary coil (Ph or Ph') is prevented, similar to the off state of the switching element (Qy).

When the switching element (Qz) is composed of, for example, a MOSFET, a parasitic diode having a forward direction between a source and a drain is provided in the switching element.

A parasitic diode (Dqz) of the switching element (Qz) is shown in FIG. 3 in order to make the above-mentioned point clear, but it is not shown in FIGS. 4 and 5.

When a semiconductor element incapable of allowing a current to bi-directionally flow is used as the switching element (Qz), it is necessary to mount a diode corresponding to the parasitic diode (Dqz) in parallel to the semiconductor element.

Further, an element having a mechanical contact, such as a relay, can be used as the switching element (Qz). In such a case, since a bi-directional current can flow, it is not necessary to mount the diode in parallel to the mechanical contact.

Next, another embodiment will be described in detail below with reference to the drawings.

Figure 6:
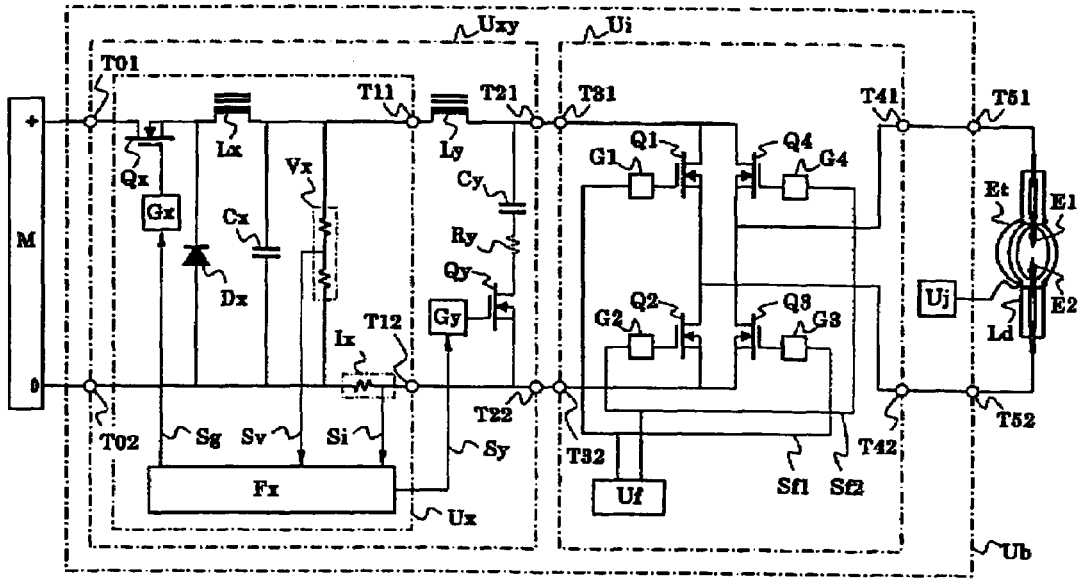
FIG. 6 is a diagram schematically illustrating an external trigger type discharge lamp lighting device according to another embodiment.

FIG. 6 is a diagram schematically illustrating the structure of an example of a discharge lamp lighting device which includes a power supply circuit composed of a step down chopper circuit and an inverter (Ui) composed of a full-bridge circuit.

The power supply circuit (Ux) including the step down chopper circuit as a base circuit receives power from a DC power supply circuit (M) composed of, for example, a PFC and adjusts the amount of current to be supplied to the discharge lamp (Ld).

In the power supply circuit (Ux), the switching element (Qx), such as an FET, breaks a current from the DC power supply (M) or releases the breaking of the current such that the current is charged into the smoothing capacitor (Cx) through a choke coil (Lx). When the switching element (Qx) is in an on state, a voltage is applied to the discharge lamp (Ld) through the inverter (Ui) to cause a current to flow through the discharge lamp (Ld).

Further, in the period where the switching element (Qx) is an on state, the current flowing through the switching element (Qx) is directly charged in the smoothing capacitor (Cx) and is also supplied to the discharge lamp (Ld), which is a load. In addition, energy is accumulated in the choke coil (Lx) in the form of magnetic flux. On the other hand, in the period where the switching element (Qx) is an off state, the energy accumulated in the choke coil (Lx) in the form of magnetic flux causes a current to be charged in the smoothing capacitor (Cx) through a flywheel diode (Dx) and to be supplied to the discharge lamp (Ld).

In the step down chopper type power supply circuit (Ux), the amount of current to be supplied to the discharge lamp can be adjusted on the basis of the ratio of the period where the switching element (Qx) is an on state to the period at an operational cycle of the switching element (Qx), that is, on the basis of a duty cycle ratio.

In this embodiment, a gate driving signal (Sg) having a predetermined duty cycle ratio is generated by a power supply control circuit (Fx) and is supplied to a gate terminal of the switching element (Qx) through a gate driving circuit (Gx) to control the gate terminal, so that the supply of current from the DC power supply (M) is controlled.

An output current detecting unit (Ix) and a lamp voltage detecting unit (Vx) detect a lamp current flowing between the electrodes (E1 and E2) of the discharge lamp (Ld) and a lamp voltage generated between the electrodes (E1 and E2), respectively.

A shunt resistor can be used as the output current detecting unit (Ix), and resistor divider can be used as the lamp voltage detecting unit (Vx).

An output current detecting signal (Si) from the output current detecting unit (Ix) and a lamp voltage detecting signal (Sv) from the lamp voltage detecting unit (Vx) are inputted to the power supply control circuit (Fx).

The inverter (Ui) is composed of a full-bridge circuit including switching elements (Q1, Q2, Q3, and Q4) respectively, for example, FETs.

The switching elements (Q1, Q2, Q3, and Q4) are driven by gate driving circuits (G1, G2, G3, and G4), respectively, and the gate driving circuits (G1, G2, G3, and G4) are controlled by inverter control signals (Sf1 and Sf2) outputted from an inverter control circuit (Uf) such that the switching elements (Q1 and Q3) and the switching elements (Q2 and Q4), which are diagonal elements of the full-bridge inverter, are turned on (saturated) at the same time, respectively.

An external-trigger-type discharge lamp (Ld) is connected to output nodes (T41 and T42) of the inverter (Ui).

The auxiliary electrode (Et) is connected to an external trigger starter circuit (Uj) for applying a high voltage pulse to the auxiliary electrode (Et) which includes the trigger circuit (Uh), the capacitor (Cj), and the high-voltage transformer (Tj) shown in FIG. 5.

A coil (Ly) is provided on an output current path between the power supply circuit (Ux) and the inverter (Ui), and a serial connection circuit of the capacitor (Cy) and the switching element (Qy) composed of, for example, an FET are connected in parallel to input nodes of the inverter (Ui).

When the microprocessor unit (Mpu) of the power supply control circuit (Fx) detects that discharge of the discharge lamp (Ld) is transferred to an arc discharge, which is an initial mode, the microprocessor unit (Mpu) waits until the discharge lamp (Ld) may return to a glow discharge has elapsed, and then activates an arc discharge transfer completion detecting signal (Sy).

When the arc discharge transfer completion detecting signal (Sy) is activated, the gate driving circuit (Gy) controls the switching element (Qy) to be turned on.

As represented by dot-dashed lines in FIG. 6, preferably, a resistor (Ry) for damping an oscillating current at the time of polarity inversion is provided in series to the capacitor (Cy), so that a series connection circuit of the resistor (Ry) and the capacitor (Cy) may be connected to or disconnected from the circuit by the switching element (Qy).

An additional capacitor may be connected in parallel to the series connection circuit. In this case, one of the series connection circuit and the additional capacitor may be connected to a node (T11).

In the period where the switching element (Qy) is in an inactive state, when the lamp fades out, an excessively high voltage will occur due to the induction of the coil (Ly), which may cause the switching elements (Q1, Q2, Q3, and Q4) to be damaged. In this case, a diode may be additionally provided between nodes (T21 and T01) such that the node (T21) serves as an anode and the node (T01) serves as a cathode.

Figure 7:
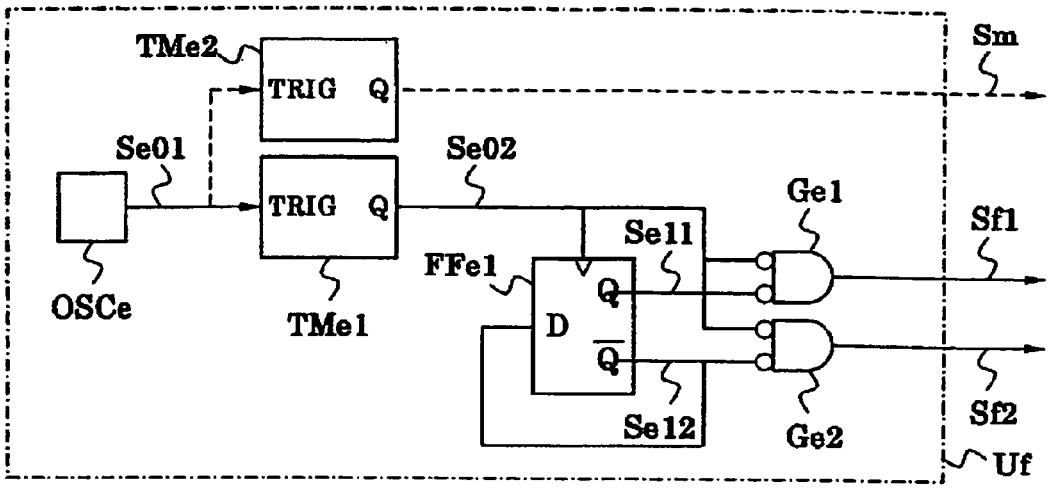
FIG. 7 is a diagram schematically illustrating the structure of an inverter control circuit.

FIG. 7 is a diagram schematically illustrating the structure of the inverter control circuit (Uf).

A signal (Se01) outputted from a polarity inversion instruction circuit (OSCe) for generating the polarity inversion timing of the inverter is inputted to a timer circuit (TMe1) composed of, for example, a monostable multivibrator, and then the timer circuit (TMe1) generates a signal SeO2 corresponding to the dead time period (τd).

The signal (SeO2) is inputted to a clock signal input terminal of a delay flip-flop (FFe1) having an input terminal connected to an inverting output terminal thereof.

An output signal and an inverted output signal of the delay flip-flop (FFe1) are respectively inputted to input terminals of NOR gates (Ge1 and Ge2), and the signal (SeO2) is inputted to the other input terminals of the NOR gates (Ge1 and Ge2).

Figure 8:
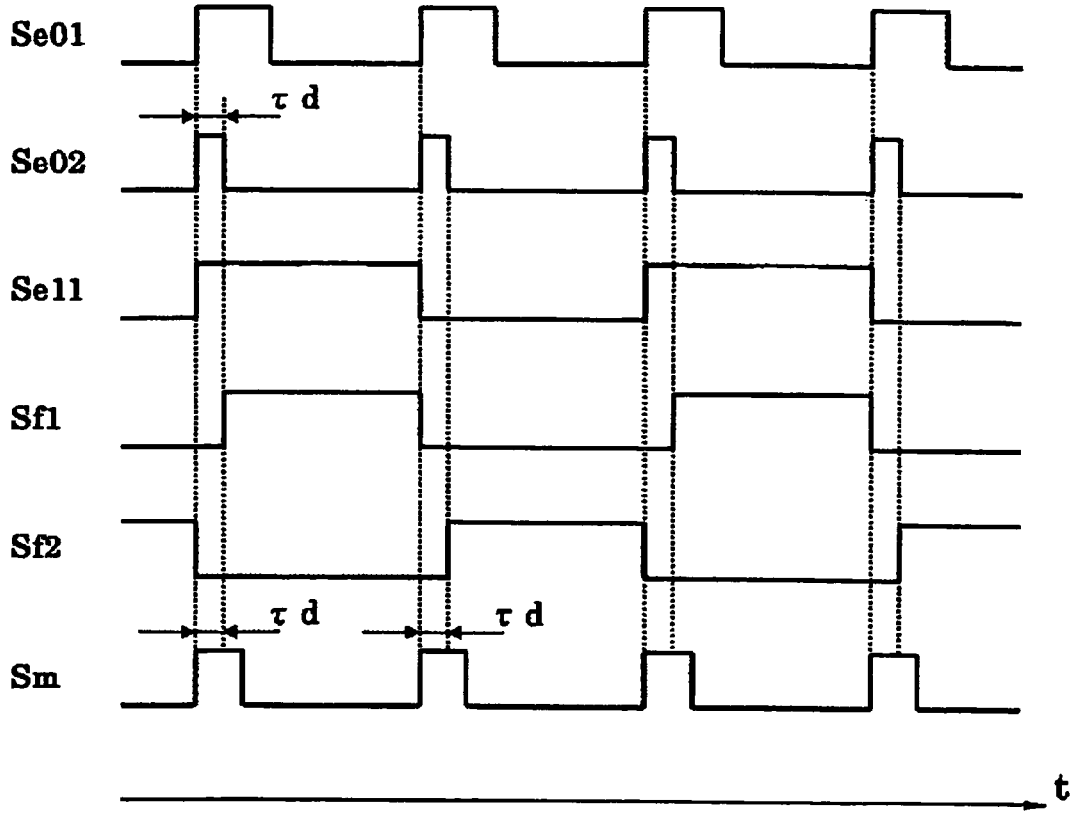
FIG. 8 is a diagram schematically illustrating a portion of a discharge lamp lighting device according to an embodiment.

FIG. 8 shows time chart showing waveforms of the above described signals. As shown in the figure, the inverter control signals (Sf1 and Sf2), have the dead time period (τd) at which both of them become inactive states, at where their active states are switched after the period, are generated, in order to use as a general inverter control signal.

As represented by broken lines in FIG. 7, the signal (Se01) is inputted to the timer circuit (TMe2), and the timer circuit (TMe2) generates a polarity inversion period signal (Sm) indicating a period where the control of an outputted current is likely to be disturbed due to polarity inversion, in order to hold the output current detecting signal (Si) or the signal outputted from the output current error calculating circuit (Ud).

For example, an independent oscillator or the microprocessor unit (Mpu) may be used as the polarity inversion instruction circuit (OSCe).

Alternatively, as described above, when the polarity inversion of the inverter (Ui) is performed in synchronization with the rotation of each filter, it is possible to use the polarity inversion instruction circuit (OSCe) as an interface unit for receiving a signal indicating a specific phase in the rotation of the filter from a DLP projector or a frequency divider for dividing the frequency of the signal.

Figure 9:
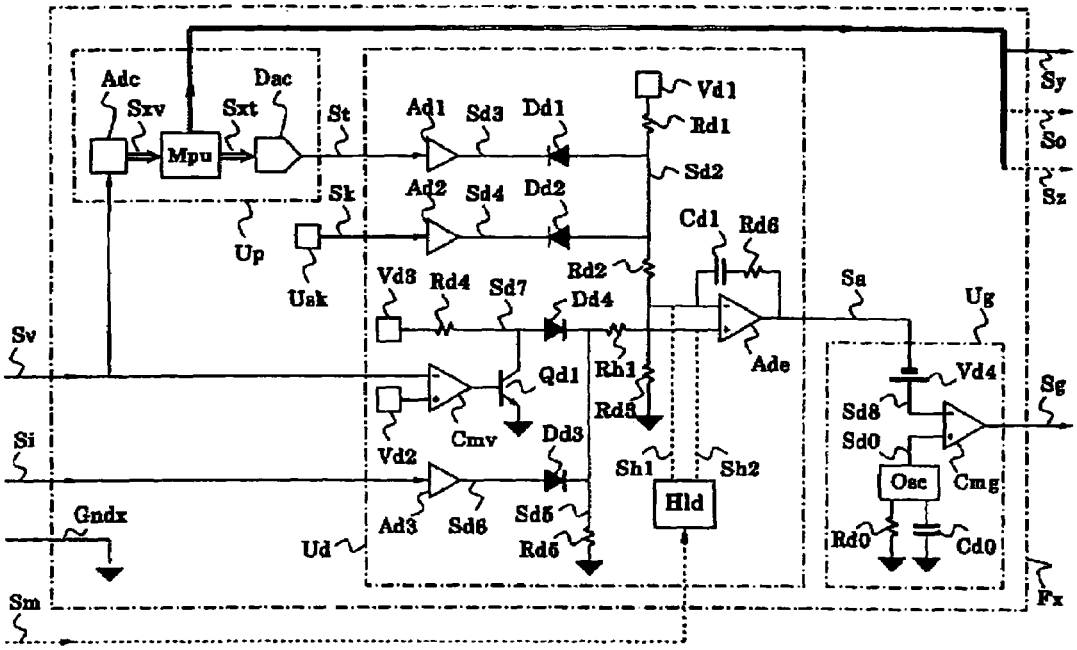
FIG. 9 is a diagram schematically illustrating a portion of a discharge lamp lighting device according to an embodiment.

FIG. 9 is a diagram schematically illustrating the structure of the power supply control circuit (Fx) shown in FIG. 1.

The lamp voltage detecting signal (Sv) is inputted to an A/D converter (Adc) of the power control circuit (Up) and is then converted into digital lamp voltage data (Sxv) having a proper digit number. Then, the converted data is inputted to the microprocessor unit (Mpu).

In this structure, the microprocessor unit (Mpu) includes a CPU, a program memory, a data memory, a clock pulse generating circuit, a time counter, and an IO controller for inputting or outputting digital signals.

The microprocessor unit (Mpu), for example, periodically updates chopper capability control target data (Sxt) for the output current error calculating control circuit (Ud), which will be described later, on the basis of calculation by referring to lamp voltage data (Sxv) or the determination of conditions corresponding to the state at that point of time.

The chopper capability control target data (Sxt) is converted into an analog output current target signal (St) by a DA converter (Dac), and the converted signal is inputted to the output current error calculating control circuit (Ud).

Further, a lamp current upper limit signal (Sk) for defining the allowable upper limit value (ILIM) of the lamp current is generated by a lamp current upper limit signal generating circuit (Usk), and is then inputted to the output current error calculating circuit (Ud).

In the output current error calculating circuit (Ud), the output current target signal (St) is supplied to one end of a pull-up resistor (Rd1) through a buffer (Ad1) or an amplifier which is provided if necessary, and a diode (Dd1), and the lamp current upper limit signal (Sk) is supplied to the one end of the pull-up resistor (Rd1) through a buffer (Ad2) or an amplifier which is provided if necessary, and a diode (Dd2). A chopper driving target signal (Sd2) is generated on the basis of the two signals. In addition, the other end of the pull-up resistor (Rd1) is connected to a reference voltage source (Vd1) having a predetermined voltage. Further, the chopper driving target signal (Sd2) is one of a signal (Sd3) corresponding to the output current target signal (St) and a signal (Sd4) corresponding to the lamp current upper limit signal (Sk) which has a small magnitude.

That is, for example, the power control circuit (Up) divides a constant corresponding to a rated power by the lamp voltage data (Sxv) to obtain the value of the lamp current for achieving the rated power, and generates the output current target signal (St) to correspond to the value by using an arbitrary method. In this structure, even when this is inappropriate, the output current error calculating circuit (Ud) controls the chopper driving target signal (Sd2) in a hardware manner such that the lamp current does not exceed the lamp current upper limit signal (Sk).

Further, control based on the AD converter (Adc) or the microprocessor unit (Mpu) causes a low operational speed (or when the operational speed increases, a manufacturing cost rises). Therefore, for example, when the discharge state of the lamp is instantly changed, the operational delay causes the generation of an unsuitable output current target signal (St). Thus, the function of limiting the current in a hardware manner is advantageous in protecting the lamp or the power supply device.

Meanwhile, the output current detecting signal (Si) is supplied to one end of a pull-down resistor (Rd5) whose other end is connected to the ground (Gndx), through a buffer (Ad3) or an amplifier which is provided, if necessary, and a diode (Dd3), so that a control target signal (Sd5) is generated.

Further, a comparator (Cmv) compares the lamp voltage detecting signal (Sv) with a voltage of a reference voltage source (Vd2) having a voltage corresponding to the no-load open circuit voltage. As the result of the comparison, when the lamp voltage detecting signal (Sv) is higher than the no-load open circuit voltage in level, a transistor (Qd1) is turned off or becomes active, and a current flows from a appropriate voltage source (Vd3) to a pull-down resistor (Rd5) through a resistor (Rd4) and a diode (Dd4). As a result, the level of the control target signal (Sd5) rises.

On the other hand, when the lamp voltage detecting signal (Sv) is lower than the no-load open circuit voltage in level, the transistor (Qd1) is turned on, and the current from the voltage source (vd3) is broken, causing the control target signal (Sd5) to correspond to the output current detecting signal (Si).

In a circuit composed of the pull-down resistor (Rd5), the diode (Dd3), and the diode (Dd4), one of the signals (Sd6 and Sd7), having a higher level, on the anode sides of the two diodes is selected, and a voltage corresponding to the selected signal is generated at the pull-down resistor (Rd5).

According to this structure, in a case where most of the output current stop flowing and the output current detecting signals (Si) are rarely inputted, when the lamp voltage detecting signal (Sv) is higher than the no-load open circuit voltage in level, the control target signal (Sd5) instantly rises. Therefore, in general, a lamp voltage (VL) is controlled in a hardware manner so as to be substantially lower than the no-load open circuit voltage.

The chopper driving target signal (Sd2) is divided by the resistors (Rd2 and Rd3) and is then inputted to an inverting input terminal of an operational amplifier (Ade). Meanwhile, the control target signal (Sd5) is inputted to a non-inverting input terminal of the operational amplifier (Ade) through the resistor (Rh1).

The output signal of the operational amplifier (Ade), that is, the capability signal (Sa) is fed back to the inverting input terminal through an integrating capacitor (Cd1) and a speed-up resistor (Rd6). Therefore, the operational amplifier (Ade) serves as an error integrating circuit for integrating a difference between a voltage obtained by dividing the chopper driving target signal (Sd2) by the resistors (Rd2 and Rd3) and the voltage of the control target signal (Sd5).

Figure 10:
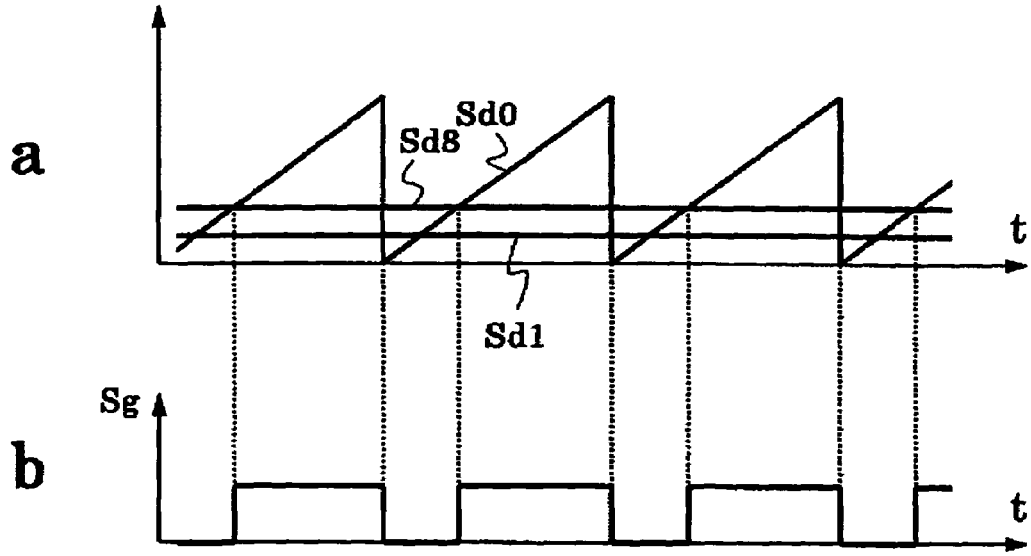
FIG. 10 is a timing chart of a portion of a discharge lamp lighting device according to an embodiment.

In the power supply driving circuit (Ug), an oscillator (Osc) connected to a capacitor (Cd0) and a resistor (Rd0) for determining a time constant generates a sawtooth wave signal (Sd0) shown in 'a' of FIG. 10, and a comparator (Cmg) compares the sawtooth wave signal (Sd0) with the capability signal (Sa) outputted from the output current error calculating circuit (Ud).

In the comparison, the sawtooth wave signal (Sd0) is compared with a signal (Sd8) obtained by adding an offset voltage (Vd4) to the capability signal (Sa).

A high-level gate driving signal (Sg) is generated in the period where the voltage of the sawtooth wave signal (Sd0) is higher than the voltage of the signal (Sd8), and is then outputted from the output current error calculating circuit (Ud).

As described above, the signal (Sd8) is obtained by adding the offset to the capability signal (Sa). Therefore, even if the capability signal (Sa) is zero, the duty cycle ratio of the gate driving signal (Sg) has a maximum value smaller than a one-hundred percent of duty cycle ratio, that is, the duty cycle ratio is smaller than a maximum duty cycle ratio.

In FIG. 10, 'a' and 'b' show the relationship among the capability signal (Sa), the signal (Sd8) obtained by adding the offset to the capability signal (Sa), the sawtooth wave signal (Sd0), and the gate driving signal (Sg).

When the gate driving signal (Sg) outputted from the power supply driving circuit (Ug) is inputted to the gate driving circuit (Gx), the output current detecting signal (Si) and the lamp voltage detecting signal (Sv) are fed back to the switching element (Qx), so that a feedback control system is formed.

In addition, in the output current error calculating circuit (Ud) shown in FIG. 9, an integrated circuit of the operational amplifier (Ade), the oscillator (Osc), and the comparator (Cmg), which is obtainable from the market, can be formed of, for example, TL494 manufactured by TEXAS INSTRUMENTS INCORPORATED.

In the feedback control system of the discharge lamp lighting device including the power supply control circuit (Fx) shown in FIG. 9, a response speed depends on the capacitance of the integrating capacitor (Cd1) and the resistance of the speed-up resistor (Rd6).

When the output current detecting signal (Si) is affected by the instant stop of the lamp current due to the dead time period of the inverter (Ui), the feedback control is performed to correct the signal. At that time, the overshoot or oscillation of the lamp current may occur due to minute feedback control when the inverter (Ui) performs polarity inversion. In this case, in order to reduce the overshoot or oscillation of the lamp current, it is preferable to increase the capacitance value of the integrating capacitor (Cd1) or to decrease the resistance value of the speed-up resistor (Rd6), thereby preventing a sensitive response.

Further, it is also effective that a capacitor be additionally provided in parallel to a series circuit comprising the integrating capacitor (Cd1) and the speed-up resistor (Rd6), thereby delaying a response.

The principle of the control process of holding the output signal of the output current error calculating circuit (Ud) by using the polarity inversion period signal (Sm) that is generated by the circuit shown in FIG. 7 and indicates the period where the control of an output current is likely to be disturbed due to polarity inversion, has already been described with reference to FIG. 2. Next, a circuit for the control process will be described in detail below with reference to FIG. 9.

Figure 11:
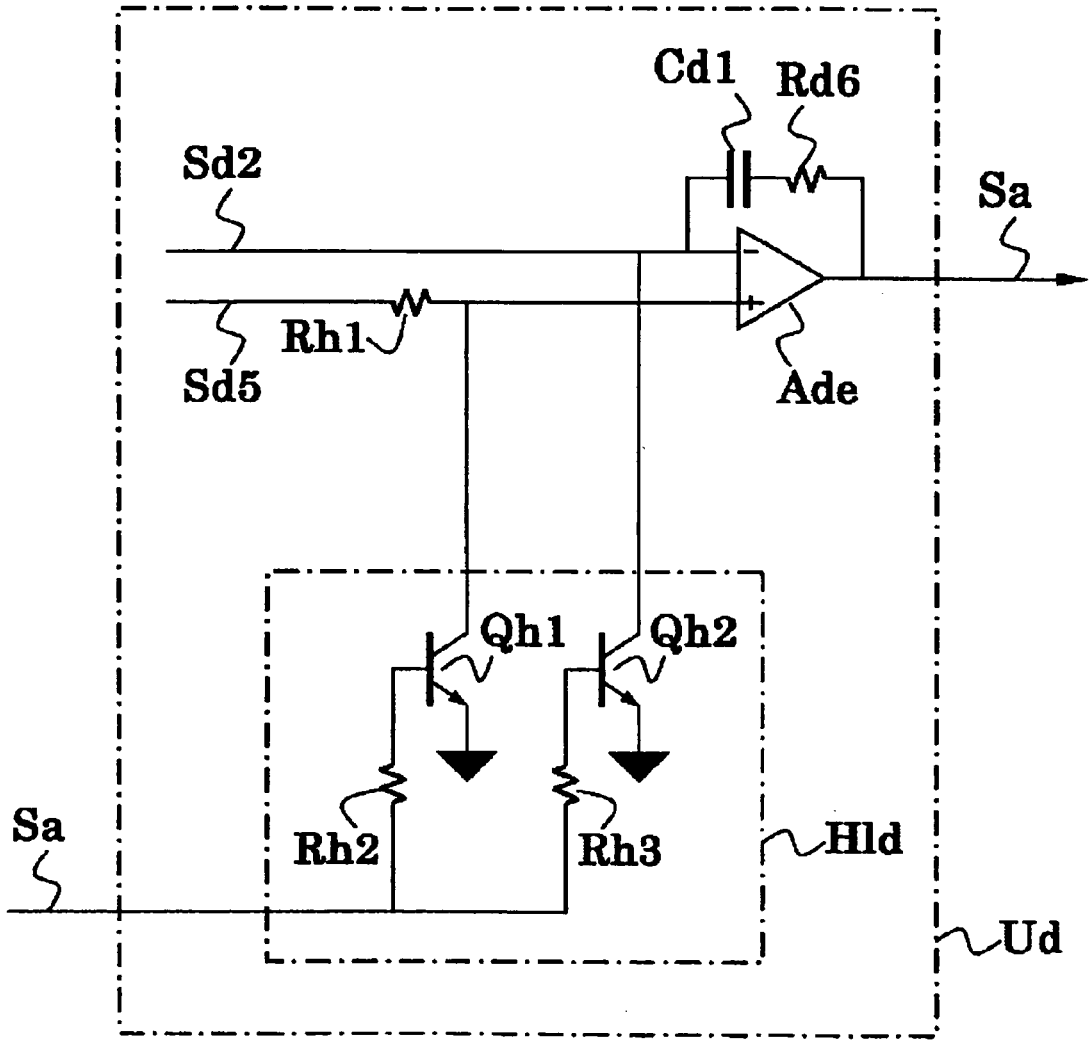
FIG. 11 is a diagram schematically illustrating a portion of a discharge lamp lighting device according to an embodiment.

The detailed structure of a hold control circuit (Hld) represented by a solid line in FIG. 9 is shown in FIG. 11.

When the polarity inversion period signal (Sm) is activated, the transistors (Qh1 and Qh2) are turned on, thereby causing both the inverting input terminal and the non-inverting input terminal of the operational amplifier (Ade) to be connected to the ground. As a result, since an error integrating circuit composed of the operational amplifier (Ade) stops an integrating operation, the capability signal (Sa), which is an output signal of the error integrating circuit, holds an integral value when the polarity inversion period signal (Sm) is activated.

In the period where the polarity inversion period signal (Sm) is in an active state, the inverter (Ui) performs polarity inversion, and the polarity inversion period signal (Sm) returns to an inactive state after the value of the lamp current returns to the original value.

In this way, the connection between the inverting input terminal and the non-inverting input terminal of the operational amplifier (Ade) is released, and thus the holding of the capability signal (Sa) is released, causing the feedback control of the output current to be resumed.

The above-mentioned circuit structures are just illustrative examples for describing the operation, function, and effect of the discharge lamp lighting device of the invention, but the invention is not limited thereto. Therefore, the invention premises that a detained circuit structure or operation, for example, the polarities of signals, can be changed at the time when the device is actually designed, on the basis of the selection, and/or omission of circuit elements, the convenience of acquisition of elements, and economic reasons.

In particular, the invention premises that a structure for protecting switching elements composed of, for example FETs from, for example, an over voltage, an over current, and overheating, or a structure for reducing radiation noise or conduction noise generated by the operation of circuit elements of a power supply circuit or preventing the generated noise from being transmitted to the outside, for example, a snubber circuit, a varistor, a clamping diode, a current control circuit (which includes a pulse-by-pulse method), a common-mode or normal-mode noise filter choke coil, or a noise filter capacitor, can be additionally provided to each unit of the circuit structures described in the embodiments, if necessary. The structure of the discharge lamp lighting device according to the invention is not limited to the above-mentioned circuit structures, and is not also limited to the above-mentioned waveforms or timing charts.

Further, for example, in the above-described embodiments, the lamp voltage detecting signal corresponding to the lamp voltage is converted from an analog signal to a digital signal, and the output current target signal is set on the basis of the converted signal. However, the output current detecting signal corresponding to the lamp current may be converted into a digital signal, and the output current target signal may be corrected and set such that the obtained current value is equal to the target current value, which makes it possible to correct a variation in the parameters of each circuit element, resulting in a high-precision and high-performance device. In addition, for example, the microprocessor unit may be removed to simplify the control circuit. A light source device with these variable structures can also exhibit the effects of the invention.

The preceding description has been presented only to illustrate and describe exemplary embodiments of the systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A discharge lamp lighting device which turns on a discharge lamp by an arc discharge, comprising:

a power supply circuit which supplies power to the discharge lamp;

an inverter which is provided in a downstream side of the power supply circuit and inverts polarity of a voltage to be applied to the discharge lamp;

a coil which is provided between the power supply circuit and the inverter; and a series connection circuit of a capacitor and a switching element which is connected in parallel to power input side nodes of the inverter, wherein the switching element is controlled to be turned on after discharge state of the discharge lamp is changed to an arc discharge, and when the inverter performs polarity inversion, a dead time period is controlled so as to be 2 μs or shorter at least in a normal lighting operation of the discharge lamp.

2. The discharge lamp lighting device according to claim 1, wherein the power supply circuit includes:

an output current detecting unit which detects an output current of the power supply circuit and generates an output current detecting signal an output current error calculating circuit which calculates an error between the output current detecting signal and an output current target signal indicating a control target value with respect to the output current detecting signal; and a power supply driving circuit which defines a capability of the power supply circuit based on the output of the output current error calculating circuit, and at least in the normal lighting operation of the discharge lamp, at least one of an output signal of the output current error calculating circuit and the output current detecting signal is held for a predetermined period including the dead time period (τd) of the inverter.

3. The discharge lamp lighting device according to claim 1, further comprising:

a booster which includes a primary coil and a secondary coil and temporarily raises a no-load open circuit voltage to be applied to the discharge lamp at time of starting; and a trigger unit which is provided to apply a voltage to the primary coil so that a predetermined boosting voltage is generated in the secondary coil, wherein the secondary coil is provided between an output node of the inverter and the discharge lamp (Ld), and the inductance of the secondary coil is set to be 60 μH or smaller.

4. The discharge lamp lighting device according to claim 2, further comprising:

a booster which includes a primary coil and a secondary coil and temporarily raises a no-load open circuit voltage to be applied to the discharge lamp at time of starting; and a trigger unit which is provided to apply a voltage to the primary coil so that a predetermined boosting voltage is generated in the secondary coil, wherein the secondary coil is provided between an output node of the inverter and the discharge lamp (Ld), and the inductance of the secondary coil is set to be 60 μH or smaller.

5. The discharge lamp lighting device according to claim 1, further comprising:

a booster which includes a primary coil and a secondary coil and temporarily raises a no-load open circuit voltage to be applied to the discharge lamp at time of starting; and a trigger unit that is provided to apply a voltage to the primary coil so that a predetermined boosting voltage is generated in the secondary coil, wherein the secondary coil is provided between an output node of the inverter and the discharge lamp, and the primary coil is shorted at least in the normal lighting operation of the discharge lamp.

6. The discharge lamp lighting device according to claim 2, further comprising:

a booster which includes a primary coil and a secondary coil and temporarily raises a no-load open circuit voltage to be applied to the discharge lamp at time of starting; and a trigger unit that is provided to apply a voltage to the primary coil so that a predetermined boosting voltage is generated in the secondary coil, wherein the secondary coil is provided between an output node of the inverter and the discharge lamp, and the primary coil is shorted at least in the normal lighting operation of the discharge lamp.

7. The discharge lamp lighting device according to claim 1, wherein an overshoot of an absolute value of a current flowing through the discharge lamp is 15% or lower when the inverter performs the polarity inversion.

8. The discharge lamp lighting device according to claim 2, wherein an overshoot of an absolute value of a current flowing through the discharge lamp is 15% or lower when the inverter performs the polarity inversion.

9. The discharge lamp lighting device according to claim 3, wherein an overshoot of an absolute value of a current flowing through the discharge lamp is 15% or lower when the inverter performs the polarity inversion.

10. The discharge lamp lighting device according to claim 4, wherein an overshoot of an absolute value of a current flowing through the discharge lamp is 15% or lower when the inverter performs the polarity inversion.

11. The discharge lamp lighting device according to claim 5, wherein an overshoot of an absolute value of a current flowing through the discharge lamp is 15% or lower when the inverter performs the polarity inversion.

12. The discharge lamp lighting device according to claim 6, wherein an overshoot of an absolute value of a current flowing through the discharge lamp is 15% or lower when the inverter performs the polarity inversion.

* * * * *